US009785100B1

(12) United States Patent
Nishimura

(10) Patent No.: US 9,785,100 B1
(45) Date of Patent: Oct. 10, 2017

(54) FIXING DEVICE AND IMAGE FORMING APPARATUS INCLUDING THE SAME

(71) Applicant: KYOCERA Document Solutions Inc., Osaka (JP)

(72) Inventor: Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/435,779

(22) Filed: Feb. 17, 2017

(30) Foreign Application Priority Data

Mar. 30, 2016 (JP) ..... 2016-068404

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/322
See application file for complete search history.

(56) References Cited

U.S. PATENT DOCUMENTS

2010/0215413 A1* 8/2010 Nakajima ..... G03G 15/2028 399/323
2016/0209791 A1* 7/2016 Kondo ..... G03G 15/2028

FOREIGN PATENT DOCUMENTS

JP 2005-221533 A 8/2005
JP 2011-227178 A 11/2011

* cited by examiner

*Primary Examiner* — Susan Lee
(74) *Attorney, Agent, or Firm* — Studebaker & Brackett PC

(57) ABSTRACT

A fixing device includes a fixing member, a pressuring member, a deforming part, an approach guide and a guide adjusting part. The fixing member is rotatable and heated by a heat source. The pressuring member is rotatable and forms a fixing nip between the fixing member and the pressuring member. The deforming part deforms the fixing nip. The approach guide guides a sheet to the fixing nip. The guide adjusting part moves the approach guide to a position corresponding to the fixing nip after deformation, as the deforming part deforms the fixing nip.

8 Claims, 14 Drawing Sheets

FIXING DEVICE AND IMAGE FORMING APPARATUS INCLUDING THE SAME

INCORPORATION BY REFERENCE

This application is based on and claims the benefit of priority from Japanese Patent application No. 2016-068404 filed on Mar. 30, 2016, which is incorporated by reference in its entirety.

BACKGROUND

The present disclosure relates to a fixing device which fixes a toner image on a sheet and an image forming apparatus including the same.

An electrophotographic type image forming apparatus includes a fixing device which fixes a toner image transferred on a sheet, such as a paper, on the sheet.

An example of the fixing device includes a pressuring roller which comes into pressure contact with an endless fixing belt which is heated. A pressing pad comes in contact with an inner circumferential face of the fixing belt to press the fixing belt to the pressuring roller. The pressing pad is made of material having a high elastic coefficient. Pressing force of the pressing pad to the pressuring roller is higher at a downstream side than at an upstream side in a movement direction of the fixing belt. By rotating the fixing belt with large curvature at an exit of a pressure contact area, the sheet can be separated from the fixing belt adequately.

Another example of the fixing device includes a pair of upper and lower approach guides which guides the sheet to a fixing nip. Each approach guide is fixed to a frame of the fixing device.

SUMMARY

In accordance with an aspect of the present disclosure, a fixing device includes a fixing member, a pressuring member, a deforming part, an approach guide and a guide adjusting part. The fixing member is rotatable and heated by a heat source. The pressuring member is rotatable and forms a fixing nip between the fixing member and the pressuring member. The deforming part deforms the fixing nip. The approach guide guides a sheet to the fixing nip. The guide adjusting part moves the approach guide to a position corresponding to the fixing nip after deformation, as the deforming part deforms the fixing nip.

In accordance with an aspect of the present disclosure, an image forming apparatus includes an image forming part and the fixing device. The image forming part transfers a toner image on a sheet. The fixing device fixes the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a preferable embodiment of the present disclosure will be described. The following description is based on directions shown in each figure.

Figure 1:
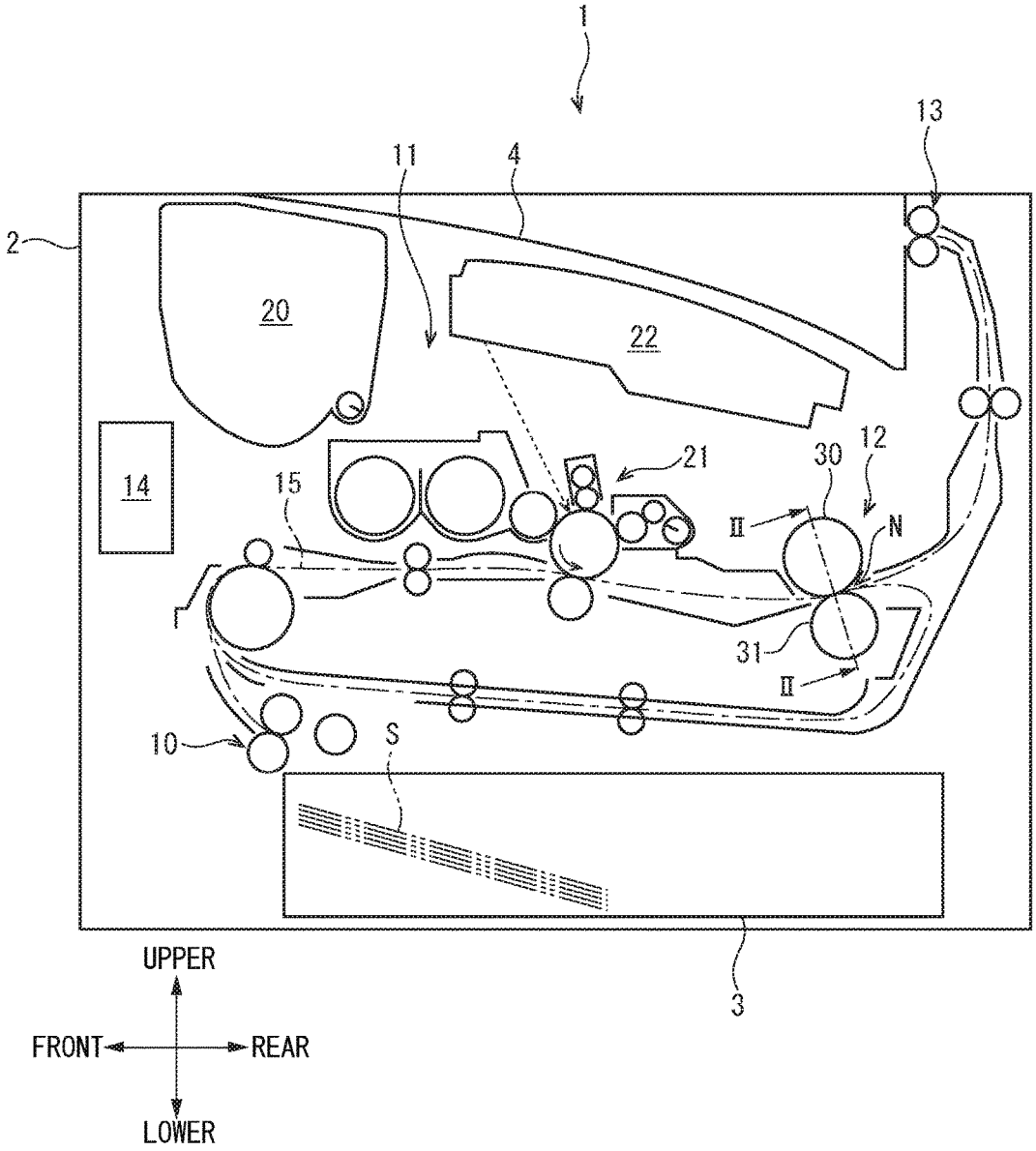
FIG. 1 is a sectional view schematically showing an inner structure of a printer according to a first embodiment of the present disclosure.

With reference to FIG. 1, a printer 1 as an image forming apparatus according to a first embodiment will be described. FIG. 1 is a sectional view schematically showing an inner structure of the printer 1. In the following description, "a conveying direction" shows a conveying direction in which a sheet S is conveyed. In addition, "an upstream", "a downstream" and other similar descriptions respectively show "an upstream" side, "a downstream" side and other similar concept in the conveying direction.

The printer 1 includes an apparatus main body 2, a sheet feeding cassette 3 and an ejection tray 4. The sheet feeding cassette 3 is provided in a lower portion of the apparatus main body 2 and stores the sheets S (a bundle of sheets S). The ejection tray 4 is formed on an upper face of the apparatus main body 2.

The printer 1 further includes a sheet feeding part 10, an image forming part 11, a fixing device 12, an ejecting part 13 and a control device 14. The sheet feeding part 10 is disposed on an upstream side end portion of a conveying path 15 extending from the sheet feeding cassette 3 to the ejection tray 4. The sheet feeding part 10 feeds the sheet S stored in the sheet feeding cassette 3 toward the conveying path 15 one by one. The image forming part 11 is disposed on a middle portion of the conveying path 15. The fixing device 12 is disposed closer to the downstream side of the conveying path 15 than the image forming part 11. The ejecting part 13 is disposed on a downstream side end portion of the conveying path 15. The control device 14 totally controls the printer 1.

The image forming part 11 has a drum unit 21 which forms a toner image using a toner (a developer) supplied from a toner container 20. The drum unit 21 develops a latent image formed by an exposure of an optical scanning device 22 into the toner image. The image forming part 11 (the drum unit 21) transfers the toner image on the sheet S conveyed along the conveying path 15. The fixing device 12 fixes the toner image on the sheet S. The sheet S having the toner image is ejected by the ejecting part 13 on the ejection tray 4.

Figure 2:
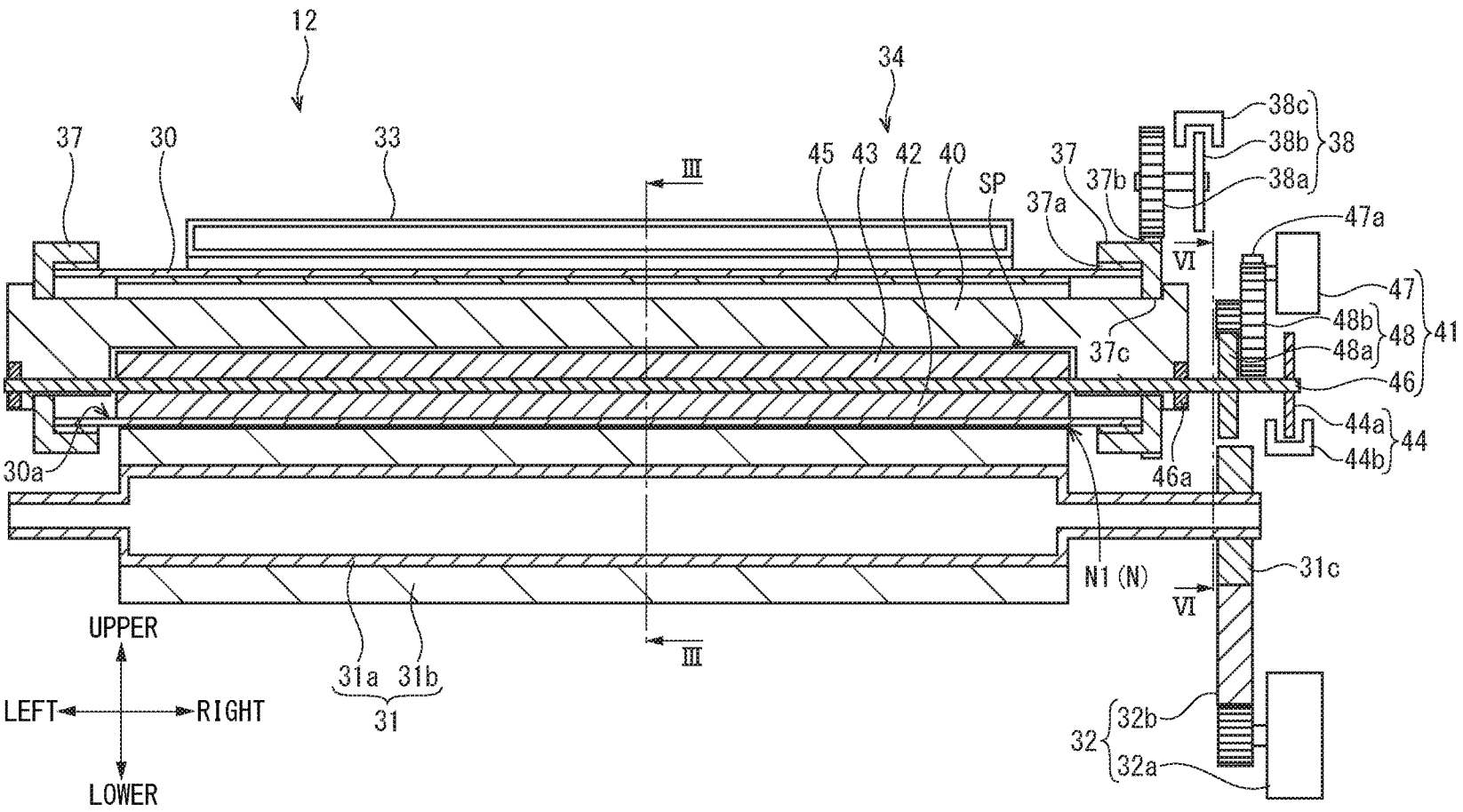
FIG. 2 is a sectional view taken along a line II-II of FIG. 1.
Figure 3:
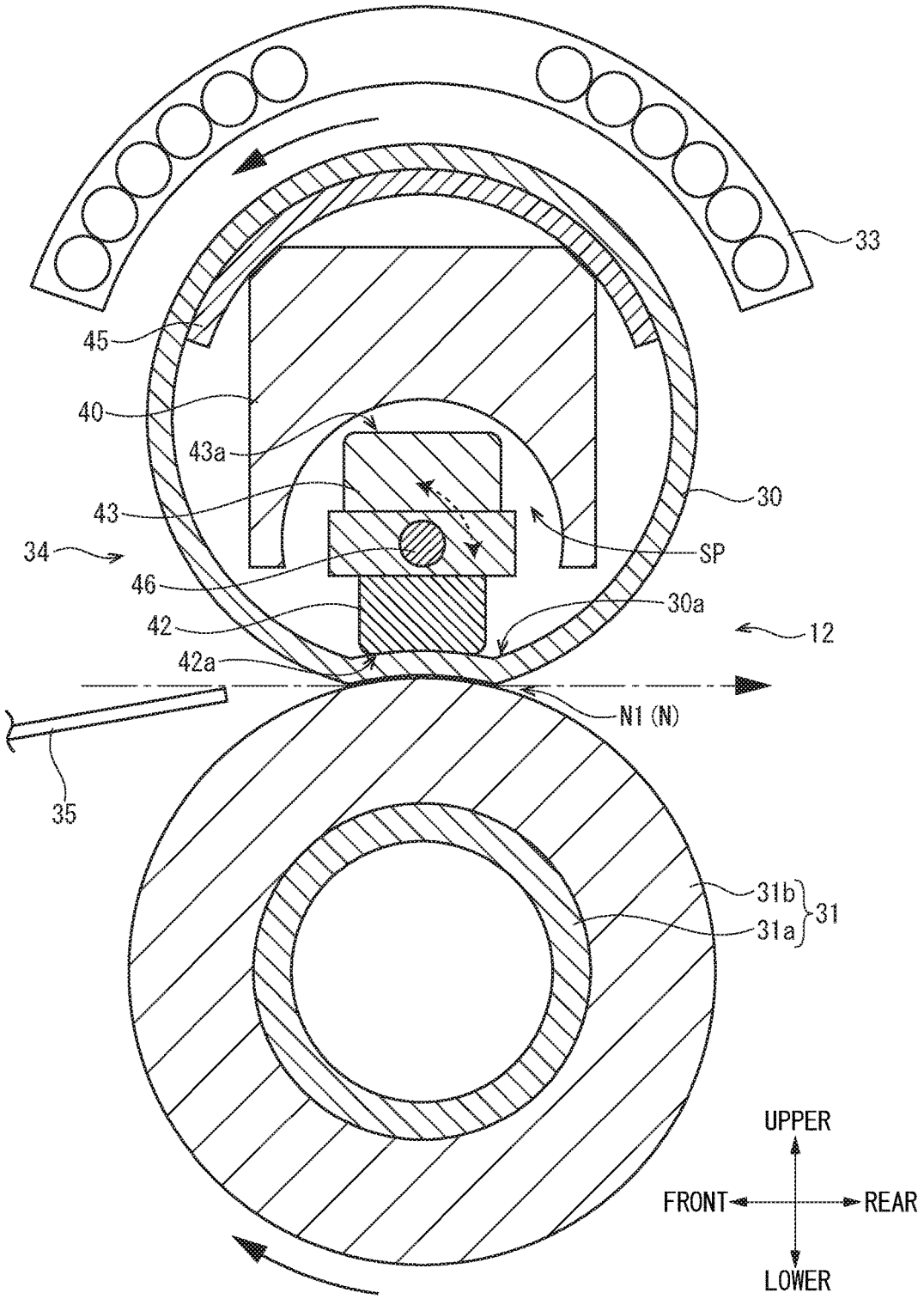
FIG. 3 is a sectional view taken along a line III-III of FIG. 2.
Figure 4:
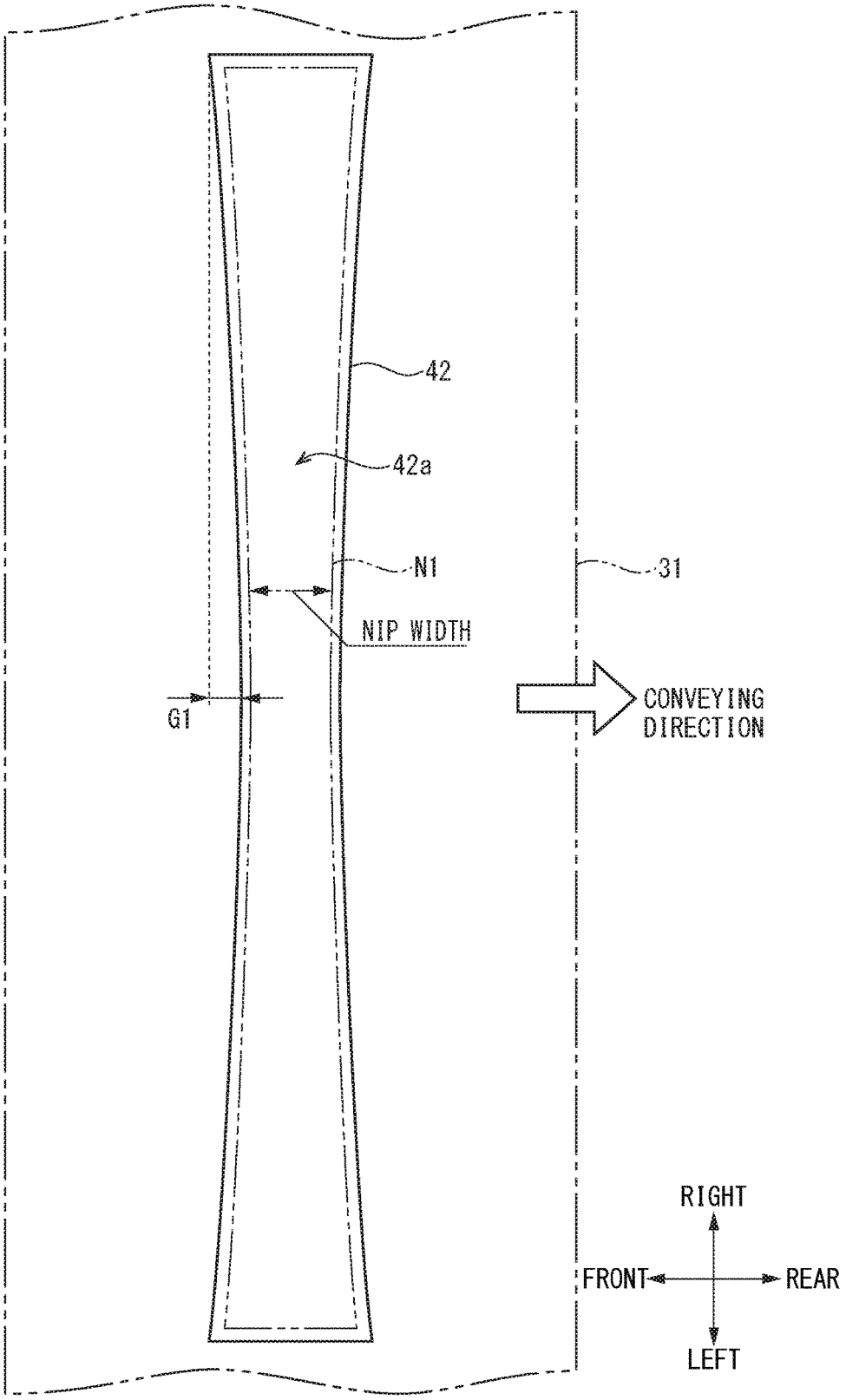
FIG. 4 is a bottom view showing a first pressing pad of a fixing device according to the first embodiment of the present disclosure.
Figure 5:
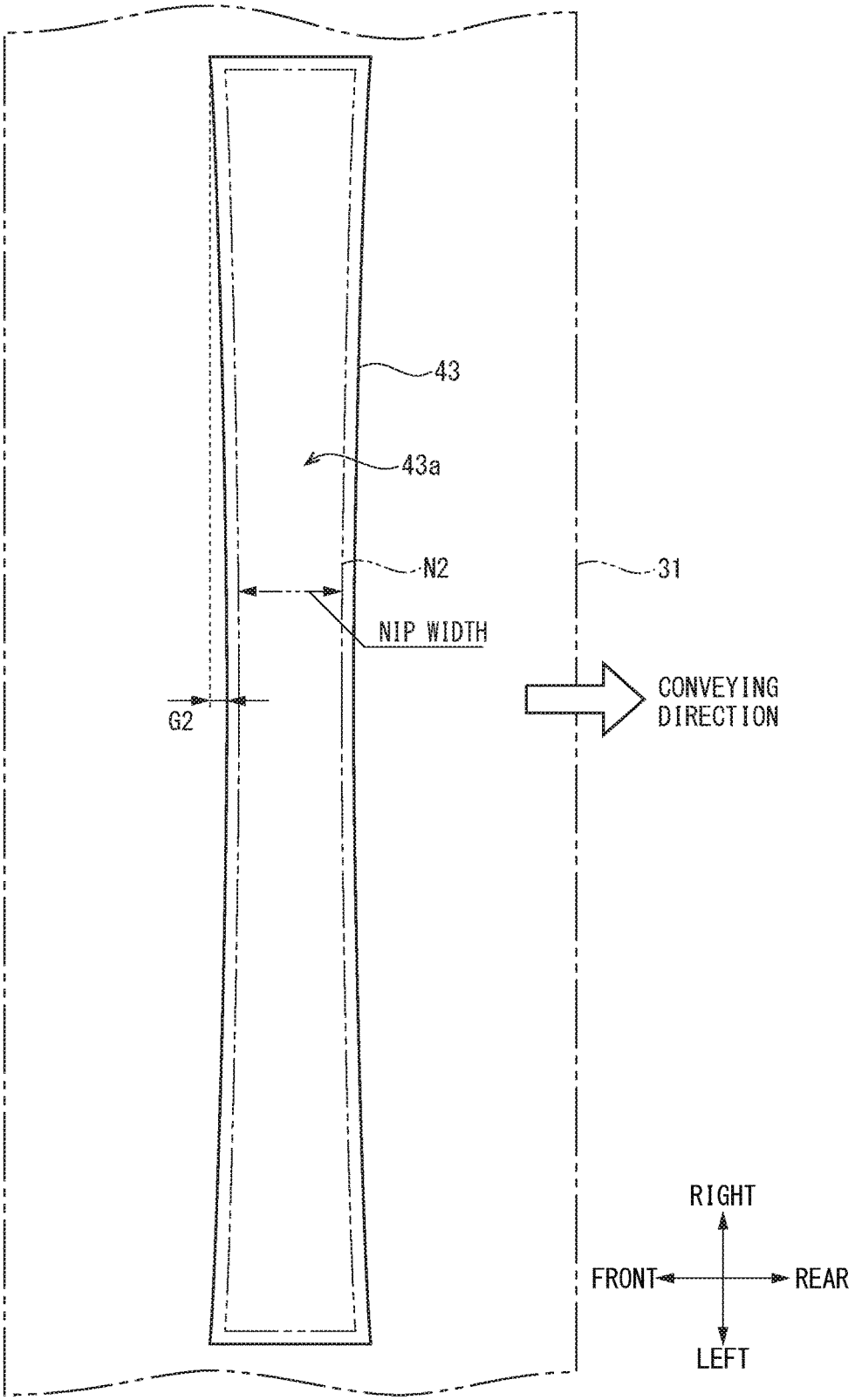
FIG. 5 is a bottom view showing a second pressing pad of the fixing device according to the first embodiment of the present disclosure.
Figure 6:
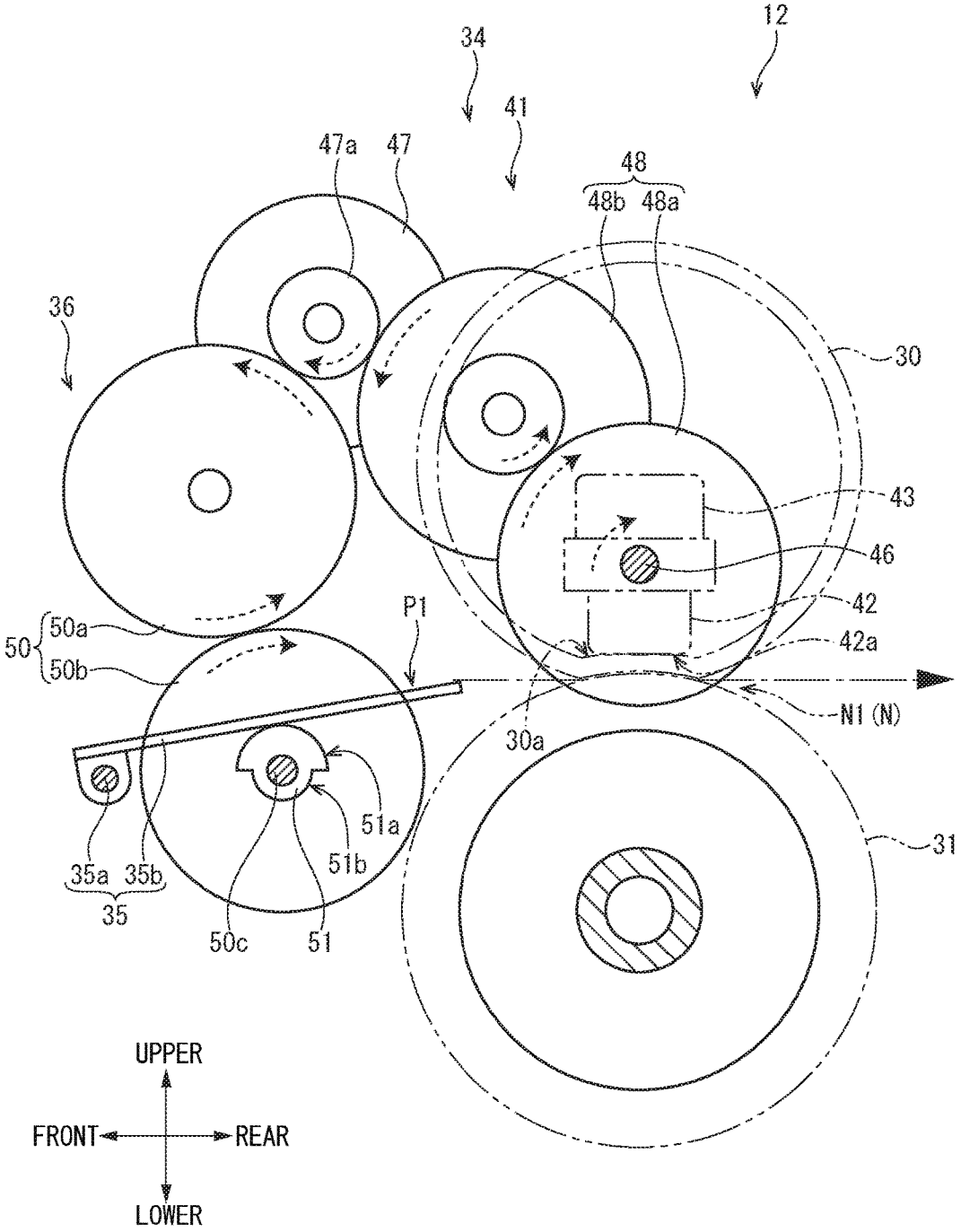
FIG. 6 is a sectional view taken along a line VI-VI of FIG. 2.
Figure 7:
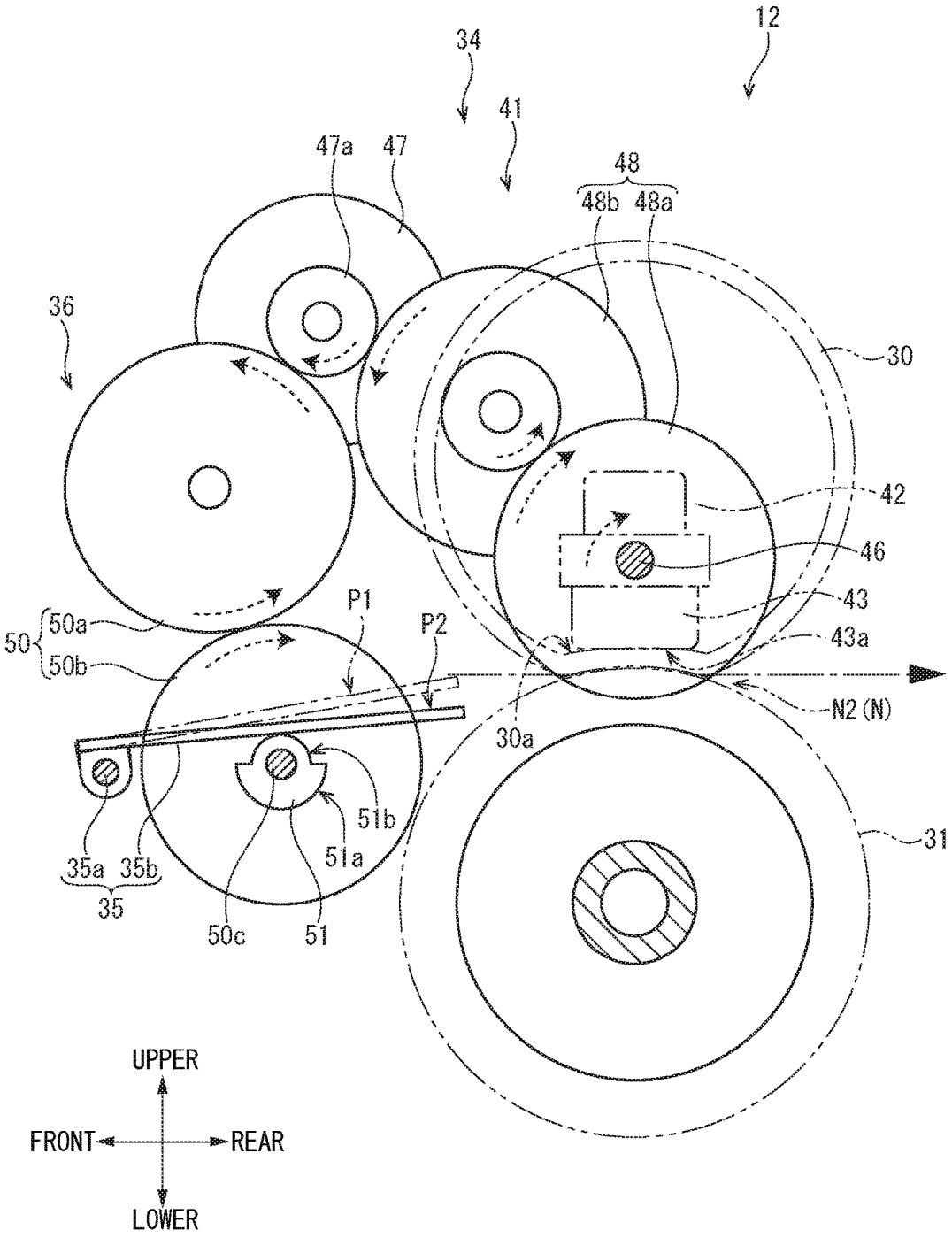
FIG. 7 is a sectional view showing a state where an approach guide is turned to a second position from a state shown in FIG. 6.
Figure 8:
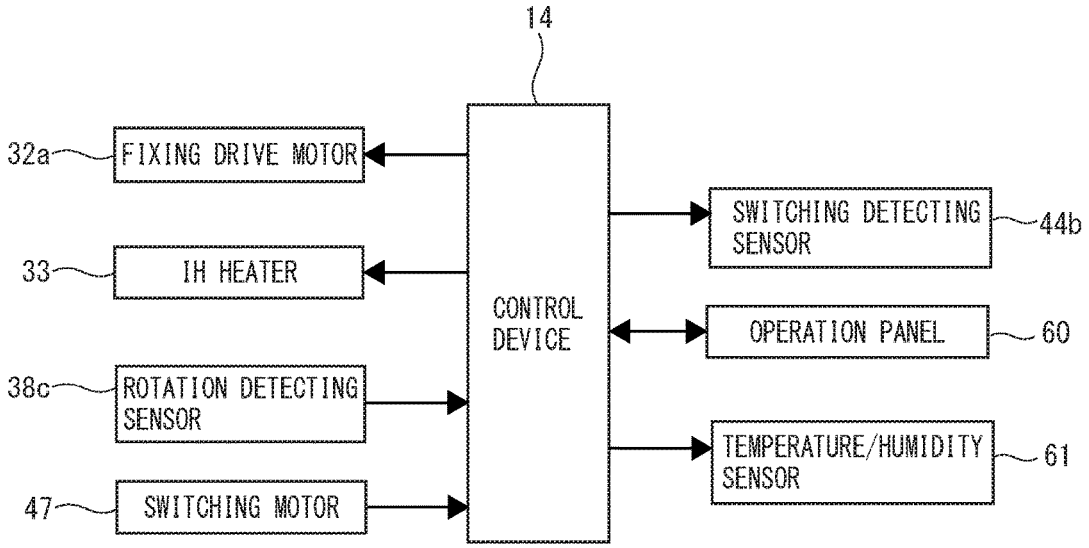
FIG. 8 is a block diagram showing a control system of the printer according to the first embodiment of the present disclosure.

Next, with reference to FIGS. 2 to 8, the fixing device 12 will be described. FIG. 2 is a sectional view taken along a line II-II of FIG. 1. FIG. 3 is a sectional view taken along a line of III-III of FIG. 2. FIG. 4 is a bottom view showing a first pressing pad 42 of the fixing device 12. FIG. 5 is a bottom view showing a second pressing pad 43 of the fixing device 12. FIG. 6 is a sectional view taken along a line VI-VI of FIG. 2. FIG. 7 is a sectional view showing a state where an approach guide 35 is turned to a second position P2 from a state shown in FIG. 6. FIG. 8 is a block diagram showing a control system of the printer 1.

As shown in FIG. 2 and FIG. 3, the fixing device 12 has a fixing belt 30, a pressuring roller 31, a fixing driving part 32, an induction heating (IH) heater 33, a deforming part 34, an approach guide 35 and a guide adjusting part 36 (refer to FIG. 6). The fixing device 12 employs a so-called sliding belt type.

The fixing belt 30 as a fixing member has flexibility, and is formed into an endless shape. The fixing belt 30 is formed into a cylindrical shape elongated in the left and right direction (a direction of a rotation axis). The fixing belt 30 is supported by the fixing frame (not shown) so as to be capable of rotating (circulating). The fixing belt 30 is formed by laminating a substrate layer, an elastic layer and a releasing layer in the order from an inner side (they are not shown). The substrate layer is made of polyimide resin mixed with nickel or metal powder, for example. The elastic layer is made of silicon rubber, for example. The releasing layer is made of fluororesin, for example.

As shown in FIG. 2, on both ends of the fixing belt 30 in the left and right direction, a pair of left and right caps 37 is attached. Each cap 37 is formed into a cylindrical shape having a closed bottom. Between an inner circumferential face of each cap 37 and an outer circumferential face of the fixing belt 30, an annular elastic member 37*a* is interposed. Around an outer circumferential face of each cap 37, a connecting gear 37*b* is formed. At a center of the bottom face (each of left and right end faces) of each cap 37, a circular through hole 37*c* is formed.

At the right side of the fixing belt 30, a rotation detecting mechanism 38 is provided. The rotation detecting mechanism 38 has a transmitting gear 38*a*, a rotating pulse plate 38*b* and a rotation detecting sensor 38*c*. The transmitting gear 38*a* is meshed with the connecting gear 37*b* of the right cap 37 to transmit rotation of the fixing belt 30 to the rotating pulse plate 38*b*. The rotating pulse plate 38*b* has a plurality of light-shielding pieces (not shown) aligned in a circumferential direction at equal intervals. The rotation detecting sensor 38*c* is a photo-interrupter having a light emitting part and a light receiving part which oppose to each other on both sides of the rotating pulse plate 38*b*. The rotation detecting sensor 38*c* transmits light receiving information changing depending on rotation of the rotating pulse plate 38*b* to the control device 14. One or more rotation detecting sensor 38*c* may be provided so as to detect rotation of at least one of the pair of left and right caps 37.

As shown in FIG. 2 and FIG. 3, the pressuring roller 31 as a pressuring member is formed into a cylindrical shape elongated in the left and right direction. The pressuring roller 31 is supported by the fixing frame so as to be rotatable. The pressuring roller 31 comes into pressure contact with the fixing belt 30 from the lower side of the fixing belt 30. Between the fixing belt 30 and the pressuring roller 31, a fixing nip N is formed. The pressuring roller 31 is formed by laminating an elastic layer 31*b* on an outer circumferential face of a core material 31*a*, for example. The core material 31*a* is made of metal, such as stainless steel and aluminum, for example. To a right end portion of the core material 31*a*, a driving gear 31*c* is fixed. The elastic layer 31*b* is made of silicon rubber or silicon sponge, for example. On an outer circumferential face of the elastic layer 31*b*, a releasing layer (fluororesin or the like, not shown) is laminated.

As shown in FIG. 2, the fixing driving part 32 has a fixing drive motor 32*a* and a drive intermediate gear 32*b*. The fixing drive motor 32*a* is connected to the driving gear 31*c* via the drive intermediate gear 32*b*. The fixing drive motor 32*a* drives the pressuring roller 31 to rotate it around a rotation axis.

As shown in FIG. 2 and FIG. 3, the IH heater 33 as a heat source is disposed at the upper side of the fixing belt 30 (an opposing side to the fixing nip N). The IH heater 33 generates magnetic field to heat the fixing belt 30.

The deforming part 34 is provided in order to press the fixing belt 30 to the pressuring roller 31. The deforming part 34 is configured to deform a shape of the fixing nip N. The deforming part 34 has a supporting stay 40, a switching adjusting part 41, two pressing pads 42 and 43, a switching detecting mechanism 44 and a belt guide 45.

The supporting stay 40 as a supporting member extends in an inner space of the fixing belt 30 in the left and right direction. Both left and right end portions of the supporting stay 40 are loosely fitted in the through holes 37*c* of the pair of left and right caps 37. The both left and right end portions of the supporting stay 40 protrude outside from the inner space of the fixing belt 30, and are supported by the fixing frame. A middle portion of the supporting stay 40 in the left and right direction has a sectional view of a substantially U-shape whose lower side is opened (refer to FIG. 3). Under the supporting stay 40, a rotation space SP is formed. On an upper face of the supporting stay 40, the arc-shaped belt guide 45 as a guide member is fixed (refer to FIG. 3). An outer circumferential face of the belt guide 45 is coming into contact with the inner circumferential face 30*a* of the fixing belt 30.

As shown in FIG. 2, the switching adjusting part 41 as a nip adjusting part has a switching rotation shaft 46, a switching motor 47 and a switching gear train 48. The switching rotation shaft 46 extends in the inner space of the fixing belt 30 in the left and right direction. To the both left and right end portions of the supporting stay 40 (the both left and right end portions outside of the caps 37), a pair of bearing parts 46*a* is provided. The switching rotation shaft 46 is supported between the pair of bearing parts 46*a*. Thereby, the switching rotation shaft 46 is supported by the supporting stay 40 via the pair of bearing parts 46*a* to be rotatable in the rotation space SP around a rotation axis. A right end portion of the switching rotation shaft 46 penetrates the bearing part 46*a* and protrudes rightward from the supporting stay 40. The switching motor 47 is connected to the switching rotation shaft 46 via the switching gear train 48. The switching motor 47 is a geared motor, for example, and rotates the switching rotation shaft 46 around the rotation axis (refer to a dashed arrow in FIG. 3).

As shown in FIG. 2 and FIG. 6, the switching gear train 48 has a switching drive gear 48*a* and a switching intermediate gear 48*b*. The switching drive gear 48*a* is a so-called spur gear, and fixed to the right end portion of the switching rotation shaft 46. The switching intermediate gear 48*b* is a so-called stepped gear, and rotatably supported by the fixing frame. A small diameter gear of the switching intermediate gear 48*b* is meshed with the switching drive gear 48*a*. A large diameter gear of the switching intermediate gear 48*b* is meshed with a pinion gear 47*a* fixed to an output shaft of the switching motor 47. The switching gear train 48 transmits drive force (rotation force) of the switching motor 47 to the switching rotation shaft 46.

The two pressing pads 42 and 43 as pressing members are each made of heat-resistant resin, such as liquid crystal polymer, and formed into a substantially rectangular parallelepiped shape elongated in the left and right direction. As shown in FIG. 2 and FIG. 3, the two pressing pads 42 and 43 oppose to each other and fixed to the switching rotation shaft 46. One pressing pad 42 is provided at a position where it is turned at 180 degrees around the switching rotation shaft 46 from the other pressing pad 43. The two pressing pads 42 and 43 respectively have pressure contact faces 42*a* and 43*a* which are configured to come into contact with the inner circumferential face 30*a* of the fixing belt 30.

The two pressing pads 42 and 43 are rotatable around the switching rotation shaft 46. The switching motor 47 is configured to be capable of keeping a position (a posture) of each of the pressing pads 42 and 43. A selected one of the two pressing pads 42 and 43 makes the downward pressure contact face 42*a* (or 43*a*) come into pressure contact with the inner circumferential face 30*a* of the fixing belt 30. Thereby, the fixing nip N is formed between the fixing belt 30 and the pressuring roller 31.

As shown in FIG. 4 and FIG. 5, the pressure contact faces 42*a* and 43*a* of the two pressing pads 42 and 43 are each formed such that its width is gradually widened from a center portion toward both end portions in the left and right direction (a direction of the switching rotation shaft 46). The pressure contact faces 42*a* and 43*a* of the two pressing pads 42 and 43 are different from each other. "A width", "a nip width" and other similar descriptions show a length of the fixing nip N in a rotation direction (or a conveying direction) of the fixing belt 30. Hereinafter, for convenience of explanation, one pressing pad 42 is also called as a first pressing pad 42 and the other pressing pad 43 is also called as a second pressing pad 43. In addition, the fixing nip N1 formed by the first pressing pad 42 is also called as a first fixing nip N1 and the fixing nip N formed by the second pressing pad 43 is also called as a second fixing nip N2. Furthermore, in a description in common to the two fixing nips N1 and N2, a reference "N" is only shown.

The first pressing pad 42 (the pressure contact face 42*a*) is formed such that a difference in the width between the both left and right end portions and the center portion in the left and right direction is larger than that of the second pressing pad 43 (the pressure contact face 43*a*) (G1>G2). A width of the center portion of the pressure contact face 42*a* in the left and right direction is narrower than a width of the center portion of the pressure contact face 43*a* in the left and right direction. That is, the pressure contact face 42*a* narrows at the center portion in the left and right direction more largely than the pressure contact face 43*a*. Accordingly, a ratio of the nip width of the both left and right end portions to the nip width of the center portion in the left and right direction is larger at the fixing nip N1 than at the fixing nip N2.

A sliding sheet made of fluororesin may be fixed on the pressure contact faces 42*a* and 43*a* of the pressing pads 42 and 43. In addition, the inner circumferential face 30*a* of the fixing belt 30 may be coated with coating material made of polyimide, polyamide-imide or polytetrafluoroethylene (PTFE).

As shown in FIG. 2, the switching detecting mechanism 44 has a switching pulse plate 44*a* and a switching detecting sensor 44*b*. The switching pulse plate 44*a* is fixed to the right end portion of the switching rotation shaft 46, and rotates together with the switching rotation shaft 46. The switching pulse plate 44*a* has a plurality of light-shielding pieces (not shown) aligned in a circumferential direction at equal intervals. The switching detecting sensor 44*b* is a photo-interrupter having a light emitting part and a light receiving part which oppose to each other on both sides of the switching pulse plate 44*a*. The switching detecting sensor 44*b* transmits light receiving information changing depending on rotation of the switching pulse plate 44*a* to the control device 14. The switching detecting mechanism 44 detects which one of the two pressing pads 42 and 43 comes into contact with the inner circumferential face 30*a* of the fixing belt 30.

As shown in FIG. 6 and FIG. 7, the approach guide 35 is provided closer to the upstream side than the fixing nip N on a side of the pressuring roller 31. The approach guide 35 guides the sheet S to the fixing nip N. The approach guide 35 has a guide shaft 35*a* extending in the left and right direction and a plurality of guide plates 35*b* fixed to the guide shaft 35*a*. FIGS. 6 and 7 each show one of the guide plates 35*b*. The guide shaft 35*a* is rotatably supported by the fixing frame. Each guide plate 35*b* is formed into a substantially plate shape. Each guide plate 35*b* is extended from the guide shaft 35*a* toward the fixing nip N.

The approach guide 35 is turnable around the guide shaft 35*a*. The approach guide 35 is turnable between a first position P1 (refer to FIG. 6) where the approach guide 35 corresponds to the first fixing nip N1 and a second position P2 (refer to FIG. 7) where the approach guide 35 corresponds to the second fixing nip N2. The approach guide 35 turned to the first position P1 directs a distal end of each guide plate 35*b* toward a side of the fixing belt 30. The second position P2 is set to be lower than the first position P1 (refer to FIG. 7).

The guide adjusting part 36 is provided in order to transmit rotation force from the switching adjusting part 41 to the approach guide 35 and to turn the approach guide 35 corresponding to deformation of the fixing nip N. The guide adjusting part 36 has a guide gear train 50 and a pair of left and right adjusting cams 51. FIGS. 6 and 7 show one of the adjusting cams 51.

The guide gear train 50 as a drive transmitting part has a guide intermediate gear 50*a* and a guide drive gear 50*b*. The guide intermediate gear 50*a* is a so-called spur gear, and rotatably supported by the fixing frame. The guide intermediate gear 50*a* is meshed with the pinion gear 47*a* of the switching motor 47. The guide drive gear 50*b* is a so-called spur gear, and fixed to an adjusting shaft 50*c* extending in the left and right direction. The guide drive gear 50*b* is meshed with the guide intermediate gear 50*a*. Accordingly, the guide intermediate gear 50*a* and the guide drive gear 50*b* are driven by the switching motor 47 to be rotated. Both left and right end portions of the adjusting shaft 50*c* are rotatably supported by the fixing frame.

A gear ratio of the switching gear train 48 (the gears 48*a* and 48*b*) to the guide gear train 50 (the gears 50*a* and 50*b*) is set such that a rotation angle of the switching rotation shaft 46 is equal to a rotation angle of each adjusting cam 51.

The pair of left and right adjusting cams 51 is fixed to the both left and right end portions of the adjusting shaft 50*c*. Each adjusting cam 51 rotates around the adjusting shaft 50*c* together with the guide drive gear 50*b*. The above described guide gear train 50 transmits the rotation force of the switching adjusting part 41 (the switching motor 47) to each adjusting cam 51. Around an outer circumferential face of each adjusting cam 51, a first cam face 51*a* and a second cam face 51*b* are formed. The first cam face 51*a* and the second cam face 51*b* are respectively formed around one half and the other half of the outer circumferential face of each adjusting cam 51. The first cam face 51*a* and the second cam face 51*b* are formed into curved faces having curvatures different from each other. The first cam face 51*a* has a curvature smaller (a radius of curvature larger) than that of the second cam face 51*b*.

Each adjusting cam 51 is provided in contact with the approach guide 35. In a state where the first cam face 51*a* of each adjusting cam 51 comes into contact with each guide plate 35*b*, the approach guide 35 is turned to the first position P1 (refer to FIG. 6). On the other hand, in a state where the second cam face 51*b* of each adjusting cam 51 comes into contact with each guide plate 35*b*, the approach guide 35 is turned to the second position (refer to FIG. 7). That is, each adjusting cam 51 is provided in order to turn the approach guide 35 corresponding to the deformation of the fixing nip N (N1, N2).

The printer 1 includes an operation panel 60 (refer to FIG. 8) through which a user performs an input operation. The user inputs a size or a type of the sheet S through the operation panel 60 or an external terminal (not shown) connected to the printer 1. The printer 1 includes a power source (not shown) which supplies power to each devices and the others, and a cooling fan (not shown) which introduces outside air into the inside of the apparatus main body 2. The power source and the cooling fan are each provided with a temperature/humidity sensor 61 (refer to FIG. 8) which detects environment temperature or environment humidity.

The above described control device 14 has an arithmetic processing part (not shown) executing an arithmetic processing according to a program stored in a storage part (not shown). As shown in FIG. 8, the fixing drive motor 32*a*, the IH heater 33, the rotation detecting sensor 38*c*, the switching motor 47, the switching detecting sensor 44*b*, the operation panel 60 and the temperature/humidity sensor 61 (each device and the others) are electrically connect to the control device 14. Each device and the others are adequately controlled by the control device 14. Another device (not shown) performing the image forming operation is also electrically connected to the control device 14 and controlled.

Next, an operation of the deforming part 34 of the fixing device 12 will be described.

Information showing the size and the type of the sheet S, which are input by the user through the operation panel 60 or the external terminal, is transmitted to the control device 14. The control device 14 controls the switching adjusting part 41 (the switching motor 47) on the basis of the type of the sheet S passing through the fixing nip N (switching control). The switching adjusting part 41 rotates the two pressing pads 42 and 43 around the switching rotation shaft 46 to switch the pressing pads 42 and 43 so as to make either one of them come into pressure contact with the inner circumferential face 30*a* of the fixing belt 30. That is, the switching adjusting part 41 deforms the fixing nip N.

For instance, when the sheet S which is easy to be crinkled, such as an envelope and a thin paper, is subjected to the fixing processing, the control device 14 controls the switching adjusting part 41 to make the first pressing pad 42 come into pressure contact with the inner circumferential face 30*a* of the fixing belt 30. In detail, the control device 14 receives an output signal (a detection result) output from the switching detecting sensor 44*b*, and recognizes that either of the two pressing pads 42 or 43 comes into contact with the inner circumferential face 30*a* of the fixing belt 30. The control device 14 controls the switching adjusting part 41 on the basis of the detection result of the switching detecting mechanism 44 (the switching detecting sensor 44*b*).

As shown in FIG. 6, when the first pressing pad 42 comes into pressure contact with the inner circumferential face 30*a* of the fixing belt 30, the control device 14 controls the switching adjusting part 41 to keep the state (not to drive the switching motor 47). In this case, the guide adjusting part 36 makes the first cam face 51*a* of each adjusting cam 51 come into contact with a lower face of the guide plates 35*b*. That is, the approach guide 35 has been already turned to the first position P1.

On the other hand, as shown in FIG. 7, when the second pressing pad 43 comes into pressure contact with the inner circumferential face 30*a* of the fixing belt 30, the guide adjusting part 36 makes the second cam face 51*b* of each adjusting cam 51 come into contact with the lower faces of the guide plates 35*b*. That is, the second nip N2 is formed, and the approach guide 35 is kept in a state where it is turned to the second position P2.

In this case, the switching motor 47 is controlled by the control device 14 to rotate the switching rotation shaft 46 by a predetermined angle (for example, 180 degrees). The switching motor 4 rotates the switching rotation shaft 46 until the first pressing pad 42 comes into contact with the inner circumferential face 30*a* of the fixing belt 30. Thereby, the fixing nip N is switched from the second fixing nip N2 to the first fixing nip N1 (refer to FIG. 6). In addition, at the same time of the rotation of the switching rotation shaft 46, the switching motor 47 rotates the guide gear train 50 and each adjusting cam 51. For instance, when the switching motor 47 rotates the switching rotation shaft 46 by 180 degrees, each adjusting cam 51 is also rotated by 180 degrees. Accordingly, each guide plate 35*b* of the approach guide 35 slides relative to each adjusting cam 51 from the second cam face 51*b* to the first cam face 51*a*. Thereby, the approach guide 35 is turned from the second position P2 to the first position P1 (refer to FIG. 6).

As described above, as the deforming part 34 deforms the fixing nip N from the second fixing nip N2 to the first fixing nip N1, the guide adjusting part 36 makes the approach guide 35 turn to the first position P1 where the approach guide 35 corresponds to the first fixing nip N1 after the deformation. The storage part of the control device 14 previously stores (sets) information showing a rotation angle of the switching rotation shaft 46 used for switching the two pressing pads 42 and 43. The control device 14 recognizes the rotation angle of the switching rotation shaft 46 on the basis of the detection result of the switching detecting sensor 44*b*. The control device 14 calculates a rotation angle of the switching motor 47 using the information stored in the storage part and the detection result of the switching detecting censor 44*b*. The switching motor 47 (the switching rotation shaft 46) may be rotated in the clockwise direction or the counterclockwise direction in FIG. 6 and FIG. 7.

In another case, when the sheet S which is hard to be crinkled, such as a plain paper and a thick paper, is subjected to the fixing processing, the control device 14 switches and controls the switching adjusting part 41 such that the second pressing pad 43 comes into pressure contact with the inner circumferential face 30*a* of the fixing belt 30. Thereby, the second fixing nip N2 is formed, and the approach guide 35 is turned to the second position P2 (refer to FIG. 7). The switching control has the same procedure as the above thin paper case, and its detailed description is omitted.

After that, the control device 14 executes the image forming processing as described above. The fixing drive motor 32*a* is controlled by the control device 14 to rotate the pressuring roller 31. The fixing belt 30 is driven by the pressuring roller 31 to be rotated. The rotation detecting sensor 38*c* detects the rotation of the rotating pulse plate 38*b*. The control device 14 receives the detection result of the rotation detecting sensor 38*c*, and then drives the IH heater 33. The IH heater 33 heats the fixing belt 30. The fixing device 12 presses and heats the sheet S passing through the fixing nip N to fix the toner image on the sheet S (the fixing processing). If the rotation detecting sensor 38*c* does not detect the rotation of the rotating pulse plate 38*b* (the fixing belt 30), the control device 14 does not drive the IH heater 33 and displays an error message on the operation panel 60 or the like.

As described above, depending on the type of the sheet S, either one of the first pressing pad 42 or the second pressing pad 43 is selected. That is, depending on the type of the sheet S, the nip width can be changed. Thereby, even in the case where the sheet S which is easy to crinkled, such as an envelope and a thin paper, is subjected to the fixing processing, the sheet S can be prevented from being crinkled.

According to the fixing device 12 of the first embodiment as described above, the guide adjusting part 36 turns (moves) the approach guide 35 corresponding to the fixing nip N (N1 or N2) deformed by the deforming part 34. In addition, the movement of the approach guide 35 by the guide adjusting part 36 is linked with the deformation of the fixing nip N by the deforming part 34. Thereby, the approach guide 35 can be turned to a position suitable for the shape of the fixing nip N so that the sheet S can be guided to the fixing nip N smoothly.

In addition, according to the fixing device 12 of the first embodiment, the switching adjusting part 41 makes one selected from the two pressing pads 42 and 43 come into pressure contact with the inner circumferential face 30*a* of the fixing belt 30. The nip width is changeable by switching the pressing pads 42 and 43. Because the fixing nips N1 and N2 each have the nip width which is wider at the both end portions than the center portion in the left and right direction, force for conveying the sheet S (conveying force) is larger at the both end portions than at the center portion in the left and right direction. Thereby, the sheet S is conveyed while extending in the left and right direction and, therefore, can be prevented from being crinkled. Accordingly, it becomes possible to form the fixing nip N where the sheet S can be conveyed appropriately, the toner image can be fixed on the sheet S appropriately and the sheet S is hard to be crinkled.

Furthermore, force for rotating each of the pressing pads 42 and 43 (rotation force) is transmitted to the approach guide 35 via the guide adjusting part 36 to turn the approach guide 35. That is, the switching adjusting part 41 is used in common as a drive source which rotates each of the pressing pads 42 and 43 and turns the approach guide 35. Thereby, the deformation of the fixing nip N and the movement of the approach guide 35 can be linked with each other by a simple configuration.

Furthermore, according to the fixing device 12 of the first embodiment, the approach guide 35 slides relative to each of the cam faces 51*a* and 51*b* of each adjusting cam 51 to be turned to a position (P1 or P2) corresponding to the fixing nip N (N1 or N2) after the deformation. In this way, use of a cam mechanism in the guide adjusting part 36 can appropriately link the deformation of the fixing nip N with the movement of the approach guide 35.

The fixing device 12 of the first embodiment is provided with the two pressing pads 42 and 43. However, the present disclosure is not limited to the number of the pressing pad. For instance, two or more pressing pads may be provided. In this case, in order to correspond to change in the number of the pressing pad (the number of the deformed shape of the fixing nip N), each adjusting cam 51 of the guide adjusting part 36 may have two or more cam faces so as to turn the approach guide 35 to two or more positions. Furthermore, in the first embodiment, the two pressing pads 42 and 43 are fixed to one switching rotation shaft 46 and rotatably supported around the switching rotation shaft 46. However, the present disclosure is not limited to the embodiment. For instance, a plurality of pressing pads may be lineally moved upward and downward.

Figure 9:
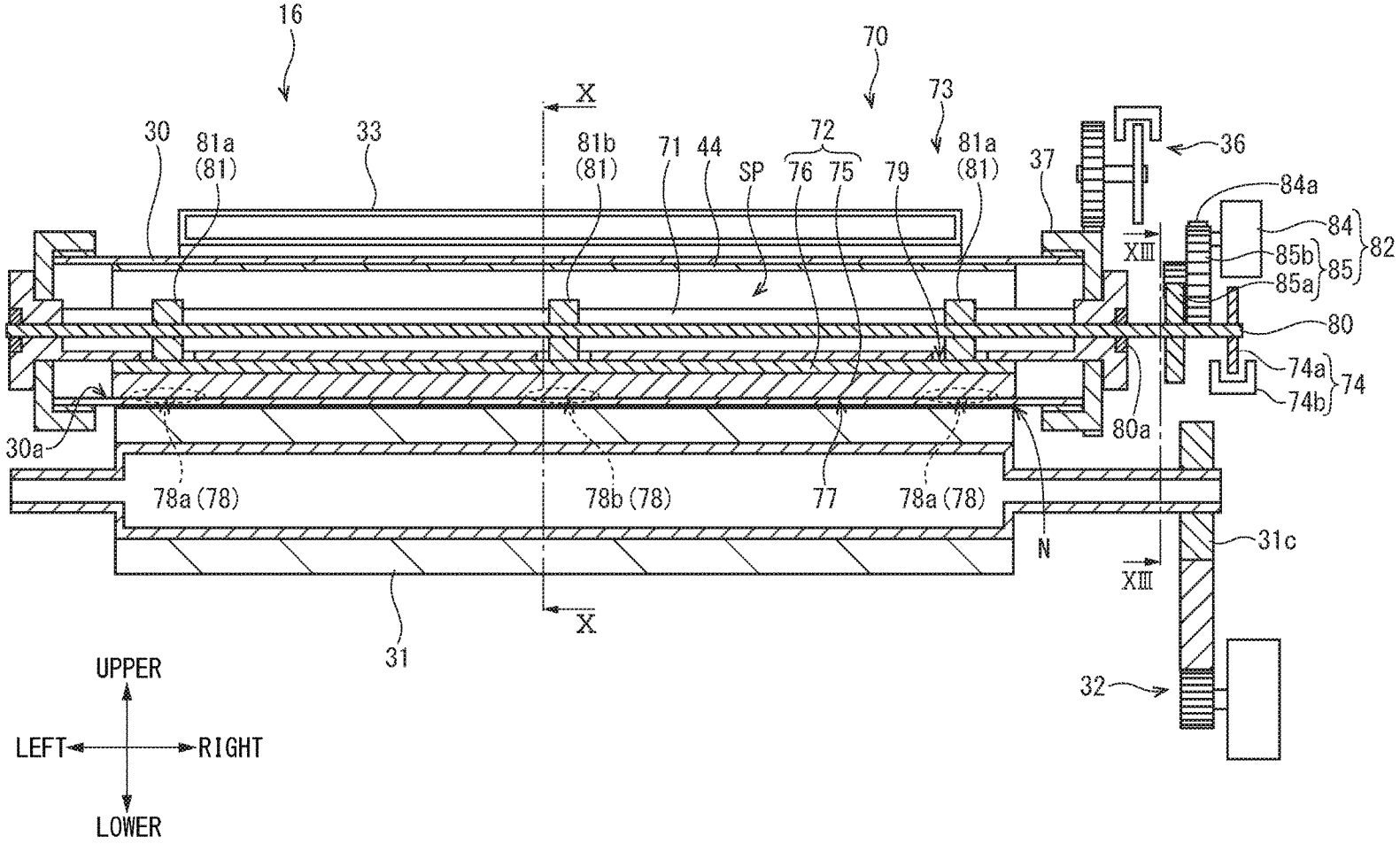
FIG. 9 is a sectional view schematically showing the fixing device according to a second embodiment of the present disclosure.
Figure 10:
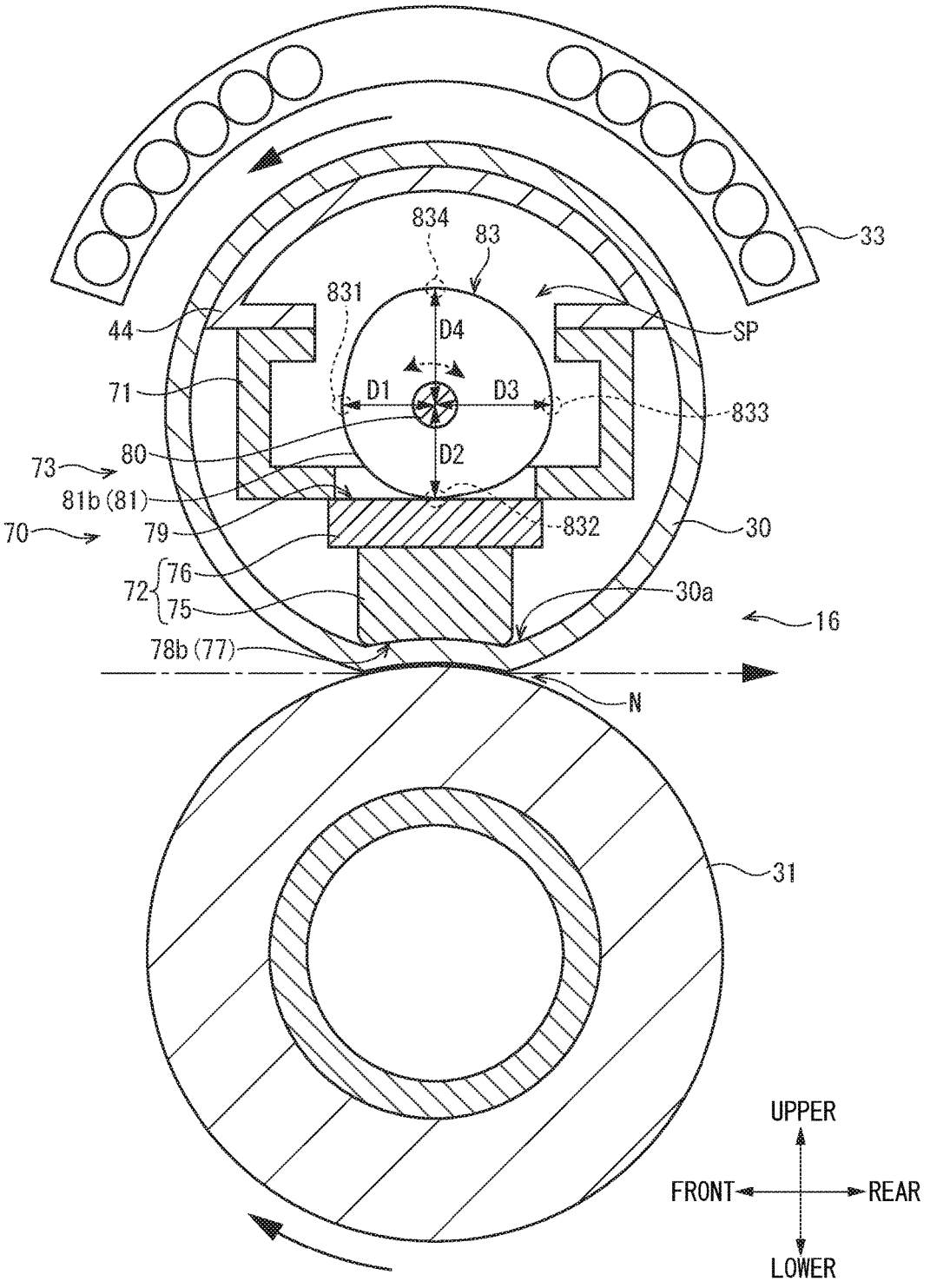
FIG. 10 is a sectional view taken along a line X-X of FIG. 9.
Figure 11:
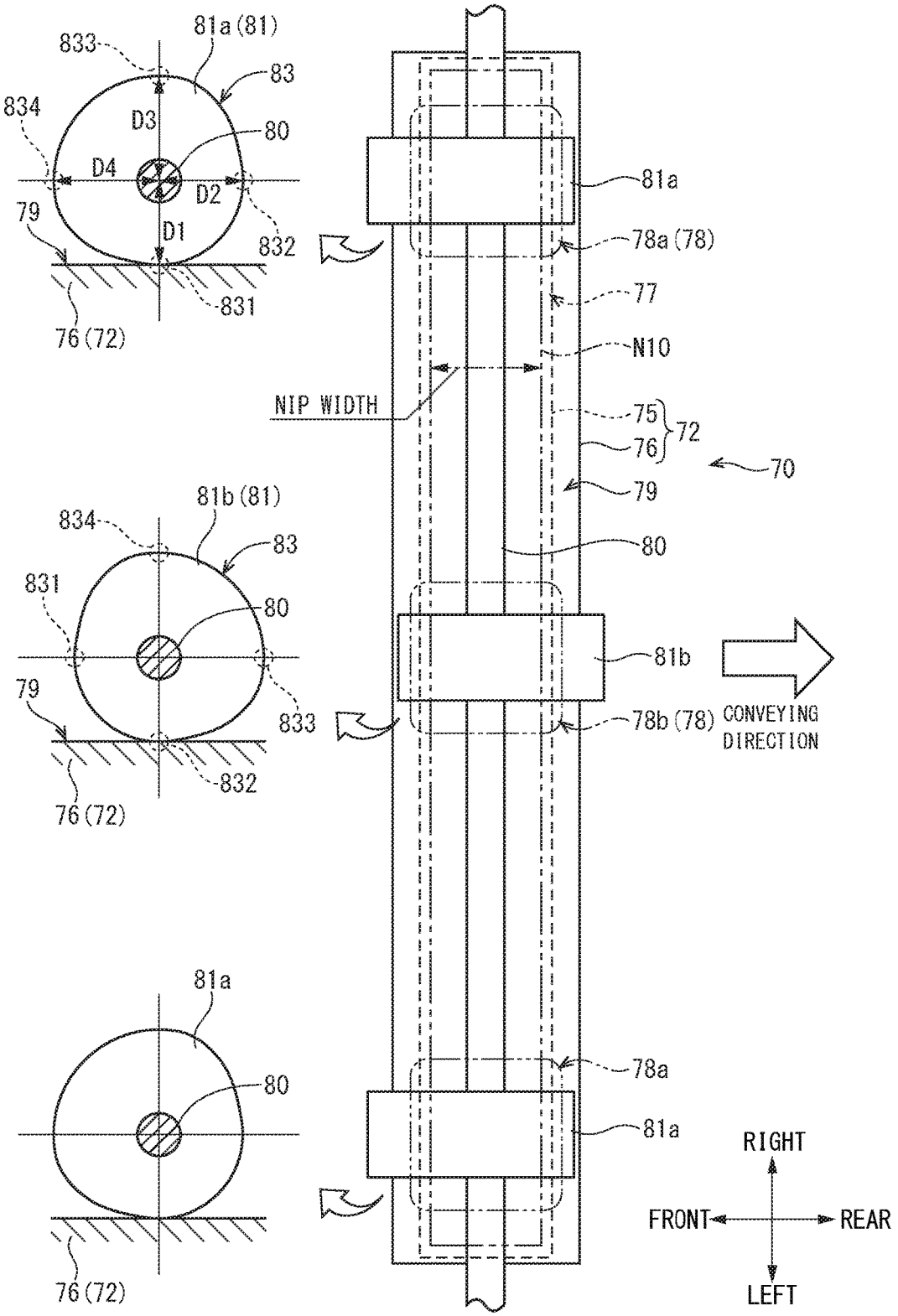
FIG. 11 is a schematic view showing a top face and a side face of a part of a deforming part (in a standard state) of the fixing device according to the second embodiment of the present disclosure.
Figure 12:
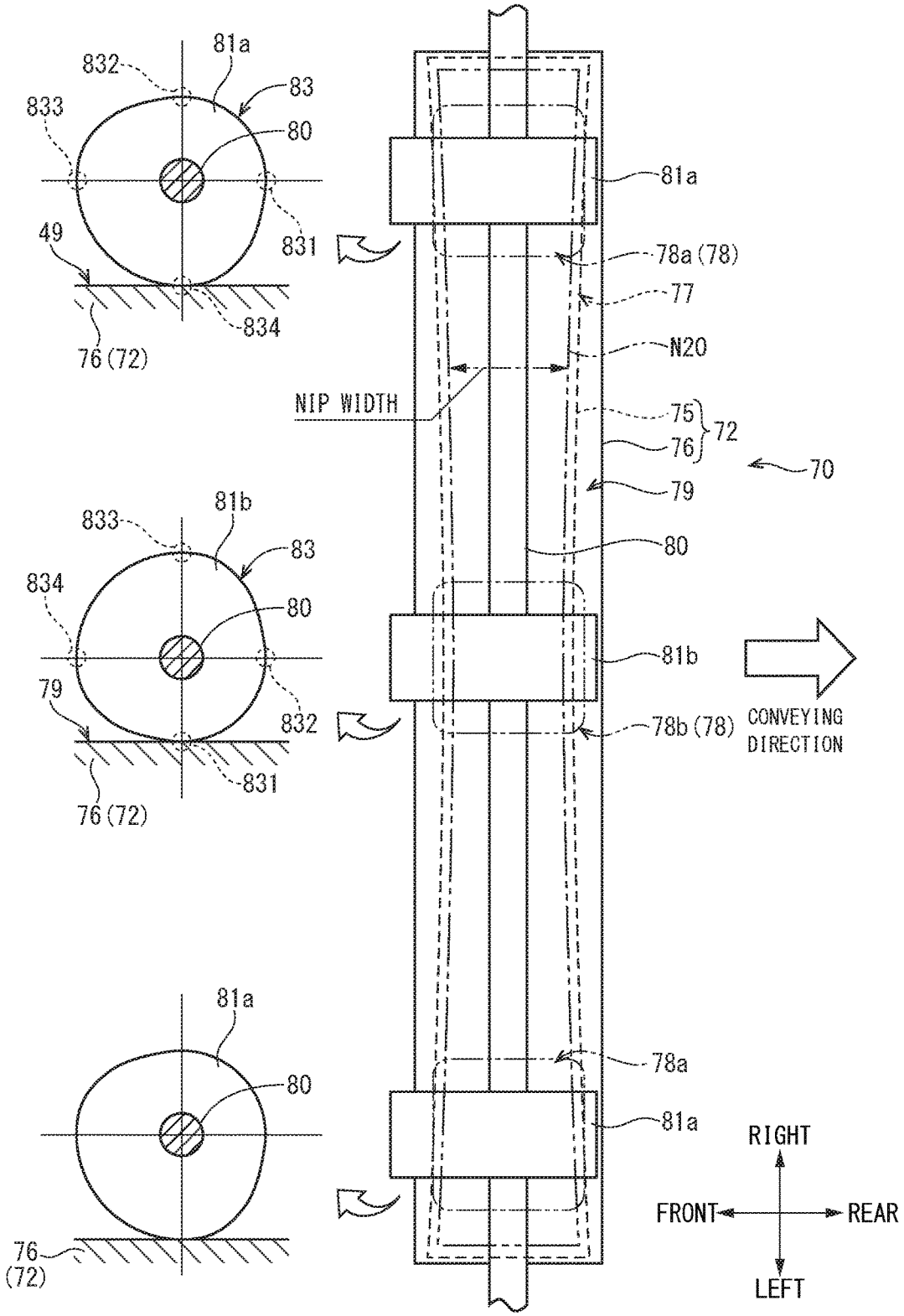
FIG. 12 is a schematic view showing the top face and the side face of the part of the deforming part (in a center pressure decreased state) of the fixing device according to the second embodiment of the present disclosure.
Figure 13:
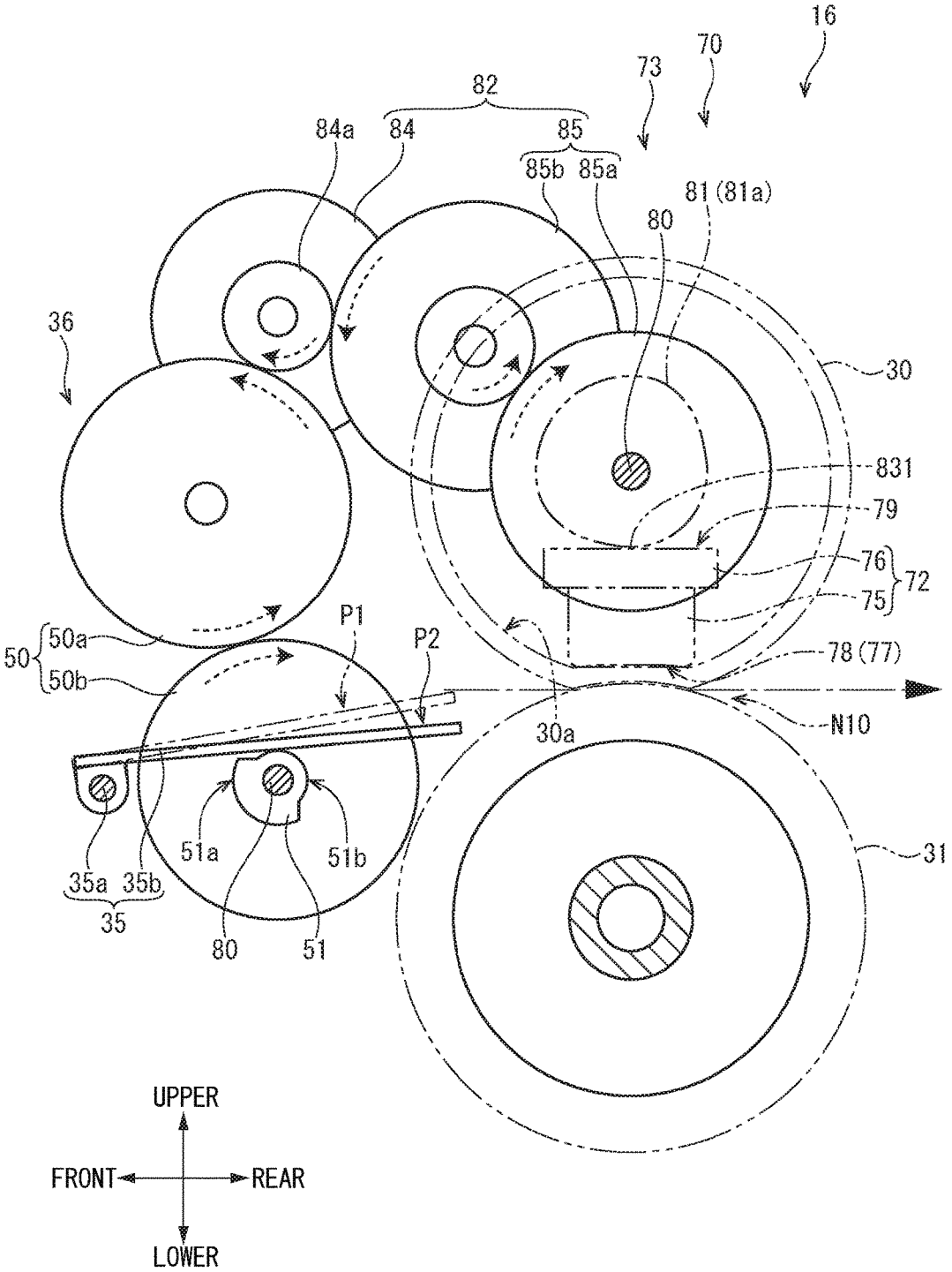
FIG. 13 is a sectional view taken along a line XIII-XIII of FIG. 9.
Figure 14:
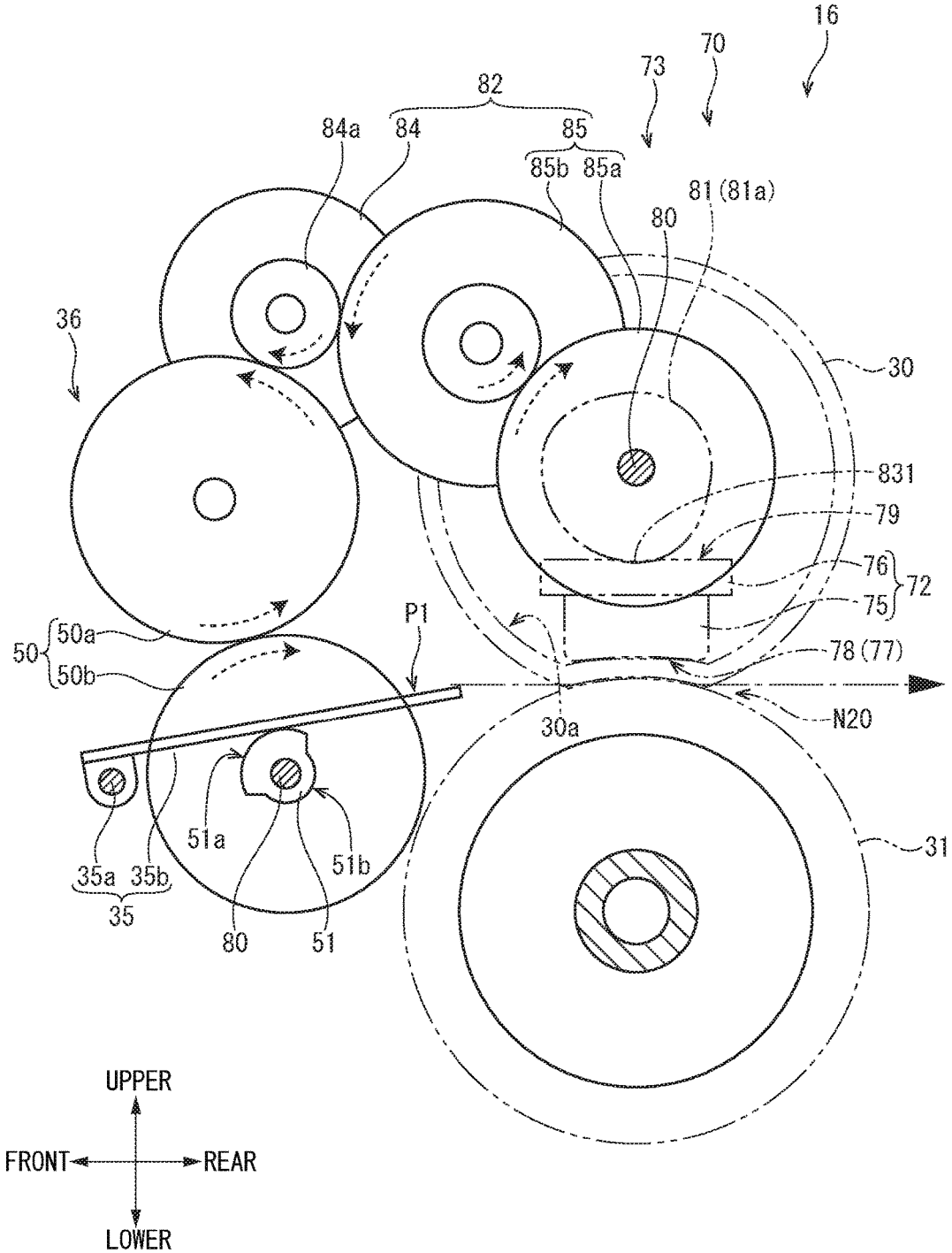
FIG. 14 is a sectional view showing a state where the approach guide is turned to a first position from a state shown in FIG. 13.

Next, with reference to FIGS. 9 to 14, the fixing device 16 of a second embodiment will be described. FIG. 9 is a sectional view schematically showing the fixing device 16 of the second embodiment. FIG. 10 is a sectional view taken along a line X-X of FIG. 9. FIG. 11 is a schematic view showing a top face and a side face of a part of a deforming part 70 (in a standard state). FIG. 12 is a schematic view showing the top face and the side face of the part of the deforming part 70 (in a center pressure decreased state). FIG. 13 is a sectional view taken along a line XIII-XIII of FIG. 9. FIG. 14 is a sectional view showing a state where the approach guide 35 is turned to the first position P1 from a state shown in FIG. 13. In the following description, the same configurations as the fixing device 12 of the first embodiment are shown with the same reference numbers as the first embodiment, and their description is omitted.

As shown in FIG. 9 and FIG. 10, the fixing device 16 of the second embodiment includes a deforming part 70 different from the deforming part 34 of the fixing device 12 of the first embodiment. The deforming part 70 has a supporting stay 71, a pressing member 72, a pressing adjusting part 73 and an angle detecting mechanism 74.

The pressing member 72 is made of heat-resistant resin, such as liquid crystal polymer, for example, and extends in the inner space of the fixing belt 30 in the left and right direction. The pressing member 72 has a pressing pad 75 and a base material 76 fixed on an upper face of the pressing pad 75. The pressing pad 75 is formed into a substantially rectangular parallelepiped shape elongated in the left and right direction. The base material 76 is formed into a substantially plate shape elongated in the left and right direction. An upper face of the base material 76 is fixed on a lower face of the supporting stay 71. The pressing pad 75 has a pressure contact face 77 which comes into pressure contact with the inner circumferential face 30*a* of the fixing belt 30. The pressure contact face 77 forms a lower face of the pressing pad 75.

As shown in FIG. 9, three pressure changing faces 78 are formed on a part (a partial area) of the pressure contact face 77 of the pressing pad 75 in the left and right direction (a direction of a rotation axis). The three pressure changing faces 78 are set at a center portion and both end portions of the pressure contact face 77 in the left and right direction at equal intervals.

As shown in FIG. 9 and FIG. 10, the pressing adjusting part 73 as the nip adjusting part has a rotation shaft 80, three eccentric cams 81 and a drive part 82. The pressing adjusting part 73 is configured so as to be able to change pressing force applied on each pressure changing face 78.

The rotation shaft 80 is supported between a pair of left and right bearing parts 80*a* so as to be rotatable around an axis in the rotation space SP. A right end portion of the rotation shaft 80 penetrates through the bearing part 80*a*, and protrudes rightward from the supporting stay 71. The three eccentric cams 81 are disposed corresponding to the three pressure changing faces 78 of the pressing member 72, and fixed to the rotation shaft 80. Each eccentric cam 81 penetrates through the supporting stay 71, and is rotatable in a state where each eccentric cam 81 is in pressure contact with the upper face (a sliding face 79) of the base material 76.

As shown in FIG. 10, each eccentric cam 81 is a disk-shaped cam whose distance from the rotation shaft 80 to a cam face 83 is not constant. Around the cam face 83 of each eccentric cam 81, a first lower point portion 831, a second lower point portion 832, a first higher point portion 833 and a second higher point portion 834 are set in the counter-clockwise direction in FIG. 10 at equal intervals. A distance D1 between the first lower point portion 831 and the rotation shaft 80 is equal to a distance D2 between the second lower point portion 832 and the rotation shaft 80. A distance D3 between the first higher point portion 833 and the rotation shaft 80 is equal to a distance D4 between the second higher point portion 834 and the rotation shaft 80. The distances D3 and D4 are longer than the distances D1 and D2. The distances D1 and D2 (the distances D3 and D4) may be different from each other.

As shown in FIG. 11, the eccentric cams 81 disposed on both end sides of the fixing belt 30 in the left and right direction are fixed to the rotation shaft 80 in a posture in which they have the same phase. The eccentric cam 81 disposed in the center portion of the fixing belt 30 in the left and right direction has the same shape as that of the eccentric cams 81 disposed on the both end sides of the fixing belt 30 in the left and right direction, and is fixed to the rotation shaft 80 in a posture in which its phase is shifted by 90 degrees with respect to the eccentric cams 81 disposed on the both end sides of the fixing belt 30 in the left and right direction. Hereinafter, for convenience of explanation, the eccentric cams 81 disposed on the both end sides of the fixing belt 30 in the left and right direction (the both end sides in the direction of the rotation axis) are also called as "end cams 81*a*", and the eccentric cam 81 disposed on the center portion of the fixing belt 30 in the left and right direction (the center portion in the direction of the rotation axis) is also called as "a center cam 81*b*". Furthermore, in a description in common to the two cams 81*a* and 81*b*, a reference number "81" is only shown. In addition, the pressure changing faces 78 corresponding to the end cams 81*a* are also called as "end pressure changing faces 78*a*", and the pressure changing face 78 corresponding to the center cam 81*b* is also called as "a center pressure changing face 78*b*". Furthermore, in a description in common to the two pressure changing faces 78*a* and 78*b*, a reference number "78" is only shown.

As shown in FIG. 9, the drive part 82 has an adjusting motor 84 and an adjusting gear train 85. The adjusting motor 84 is connected to the rotation shaft 80 via the adjusting gear train 85. The adjusting motor 84 drives each eccentric cam 81 to rotate it around the rotation shaft 80 (refer to a dashed arrow in FIG. 10). The adjusting motor 84 is a geared motor, for example, and is configured to be capable of keeping a rotation position (a posture) of each eccentric cam 81.

As shown in FIG. 9 and FIG. 13, the adjusting gear train 85 has an adjusting drive gear 85*a* and an adjusting intermediate gear 85*b*. The adjusting drive gear 85*a* is a so-called spur gear, and fixed to a right end portion of the rotation shaft 80. The adjusting intermediate gear 85*b* is a so-called stepped gear, and rotatably supported by a fixing frame (not shown). A small diameter gear of the adjusting intermediate gear 85*b* is meshed with the adjusting drive gear 85*a*. A large diameter gear of the adjusting intermediate gear 85*b* is meshed with a pinion gear 84*a* fixed to an output shaft of the adjusting motor 84. The adjusting gear train 85 transmits driving force (rotation force) of the adjusting motor 84 to the rotation shaft 80.

The guide intermediate gear 50*a* of the guide adjusting part 36 is meshed with the pinion gear 84*a* of the adjusting motor 84. Accordingly, the guide intermediate gear 50*a* and the guide drive gear 50*b* are driven by the adjusting motor 84 to be rotated. A gear ratio of the adjusting gear train 85 (the gears 85*a* and 85*b*) to the guide gear train 50 (the gears 50*a* and 50*b*) is set such that a rotation angle of the rotation shaft 80 is equal to a rotation angle of each adjusting cam 51.

As shown in FIG. 9, the angle detecting mechanism 74 has an angle pulse plate 74*a* fixed to the right end portion of the rotation shaft 80 and an angle detecting sensor 74*b* which detects rotation of the angle pulse plate 74*a*. The angle detecting mechanism 74 transmits information showing a rotation angle of each eccentric cam 81 to the control device 14. The angle detecting mechanism 74 has substantially the same configuration as the switching detecting mechanism 44, and its description is omitted.

Next, an operation of the deforming part 70 will be described. The adjusting motor 84 is controlled by the control device 14 to rotate the three eccentric cams 81 which are in contact with the sliding face 79 of the pressing member 72, around the rotation shaft 80. In this way, the pressing adjusting part 73 changes the pressing force applied on a part (the three pressure changing faces 78) of the pressure contact face 77 in the direction of the rotation axis to deform the fixing nip N. Each eccentric cam 81 is set such that either one of the point portions 831 to 834 comes into contact with the sliding face 79.

For instance, as shown in FIG. 11, a state where the first lower point portion 831 of each end cam 81*a* and the second lower point portion 832 of the center cam 81*b* come into contact with the sliding face 79 of the pressing member 72 (the base material 76) is called as "a standard state". If the rotation shaft 80 is rotated by 90 degrees, 180 degrees and 270 degrees in the clockwise direction from the standard state, each end cam 81*a* is rotated to a state where the second lower point portion 832, the first higher point portion 833 and the second higher point portion 834 come into contact with the sliding face 79 in the order. In this time, the center cam 81*b* is rotated to a state where the first higher point portion 833, the second higher point portion 834 and the first lower point portion 831 come into contact with the sliding face 79 in the order. Here, the state where the second lower point portion 832 of each end cam 81*a* and the first higher point portion 833 of the center cam 81*b* come into contact with the sliding face 79 is called as "a center pressure increased state", the state where the first higher point portion 833 of each end cam 81*a* and the second higher point portion 834 of the center cam 81*b* come into contact with the sliding face 79 is called as "an entire area pressure increased state", and the state where the second higher point portion 834 of each end cam 81*a* and the first lower point portion 831 of the center cam 81*b* come into contact with the sliding face 79 is called as "a center pressure decreased state". In addition, the fixing nips N formed under the standard state, the center pressure increased state, the entire area pressure increased state and the center pressure decreased state are respectively called as a standard nip N10 (refer to FIG. 11), a center pressure increased nip (not shown), an entire area pressure increased nip (not shown) and a center pressure decreased nip N20 (refer to FIG. 12). Furthermore, in a description in common to the nip N10 and the nip N20, a reference "N" is only shown.

The pressing member 72 is elastically deformed in the width direction depending on force with which the pressing member 72 is pressed on the inner circumferential face 30*a* of the fixing belt 30. As shown in FIG. 11, in the standard state, a standard pressing force is applied on the three pressure changing faces 78. Then, the pressing member 72 (the pressure contact face 77) is pressed on the inner circumferential face 30*a* of the fixing belt 30 with a substantially uniform pressure in the left and right direction. Thereby, the standard nip N10 is formed so as to have substantially the same width in the left and right direction. In the entire area pressure increased state (not shown), the pressure contact face 77 is pressed on the inner circumferential face 30*a* of the fixing belt 30 with a substantially uniform pressure, and the entire area pressure increased nip is formed so as to have substantially the same width, in the same way.

On the other hand, as shown FIG. 12, in the center pressure decreased state, the center pressure changing face 78*b* is applied with a first pressing force and each end pressure changing face 78*a* is applied with a second pressing force higher than the first pressing force. Then, the center portion of the pressing member 72 in the left and right direction is pressed on the inner circumferential face 30*a* of the fixing belt 30 with a force lower than that applied on the both end portions of the pressing member 72 in the left and right direction. Thereby, the center pressure decreased nip N20 is formed so as to have a nip width which is gradually widened from the center portion toward the both end portions in the left and right direction. That is, the center pressure decreased nip N20 is narrowed at the center portion in the left and right direction. In the center pressure increased state (not shown), the width of the pressure contact face 77 and the nip width of the center pressure increased nip are widened at the center portions in the left and right direction.

Next, a pressure changing control by the deforming part 70 will be described. Each eccentric cam 81 is set in the standard state.

The control device 14 controls the pressing adjusting part 73 on the basis of the type of the sheet S passing through the fixing nip N (the pressure changing control). The storage part of the control device 14 previously stores information showing a rotation angle used for recognizing a contact position where each cam face 83 (the point portions 831 to 834) comes into contact with the sliding face 79. The control device 14 recognizes the rotation angle of each eccentric cam 81 (a state of each eccentric cam 81) on the basis of a detection result of the angle detecting sensor 74*b*, and controls the adjusting motor 84. The control device 14 calculates a rotation angle of the adjusting motor 84 using the information stored in the storage part and the detection result of the angle detecting sensor 74*b*. The pressing adjusting part 73 changes the contact position where the cam face 83 of each eccentric cam 81 comes into contact with the sliding face 79 of the pressing member 72.

For instance, when the sheet S which is hard to be crinkled is subjected to the fixing processing, the control device 14 controls each eccentric cam 81 to rotate (switch) it to the standard state. That is, the control device 14 performs control for forming the standard nip N10 (refer to FIG. 11 and FIG. 13). Here, because each eccentric cam 81 has been already rotated to the standard state, the control device 14 does not drive the adjusting motor 84. In addition, in this case, the guide adjusting part 36 makes the second cam face 51*b* of each adjusting cam 51 come into contact with the lower face of the guide plate 35*b*. That is, the approach guide 35 is turned to the second position P2.

Next, for instance, when the sheet S which is easy to be crinkled is subjected to the fixing processing, the control device 14 controls each eccentric cam 81 to rotate it to the center pressure decreased state and to form the center pressure decreased nip N20 (refer to FIG. 12 and FIG. 14). The adjusting motor 84 is controlled by the control device 14 to rotate the rotation shaft 80 by 270 degrees in the clockwise direction in FIG. 13 (alternatively, by 90 degrees in the counterclockwise direction). Thereby, each eccentric cam 81 is turned to the center pressure decreased state from the standard state, and the center pressure decreased nip N20 is formed (refer to FIG. 14). Each eccentric cam 81 may be rotated in the clockwise direction or in the counterclockwise direction in FIGS. 13 and 14.

At the same time of the rotation of the rotation shaft 80, the adjusting motor 84 rotates the guide gear train 50 and each adjusting cam 51. For instance, when the rotation shaft 80 is rotated by 270 degrees in the clockwise direction in FIG. 13, each adjusting cam 51 is also rotated by 270 degrees. Accordingly, each guide plates 35*b* slides relative to the adjusting cam 51 from the second cam face 51*b* toward the first cam face 51*a*. Thereby, the approach guide 35 is turned from the second position P2 to the first position P1 (refer to FIG. 14).

After that, the control device 14 executes the image forming processing by the image forming part 11 and the others. In the above description about the pressure changing control, as an example, the standard nip N10 is formed when the sheet S, such as a plain paper and a thick paper, is subjected to the fixing processing. However, the present disclosure is not limited to the above example. For instance, the control device 14 may perform the pressure changing controls different between a thick paper and a plain paper (which is thinner than the thick paper and thicker than a thin paper). That is, the control device 14 may perform the pressure changing control to form the standard nip N10 (refer to FIG. 11) when the thick paper is subjected to the fixing processing and to form the entire area pressure increased nip (to switch each eccentric cam 81 to the entire area pressure increased state) when the plain paper is subjected to the fixing processing. A procedure of the pressure changing control is the same as the above case of the thin paper, and its description is omitted. Alternatively, depending on the type of the sheet S, the control device 14 may perform the pressure changing control to form the center pressure increased nip (to switch each eccentric cam 81 to the center pressure increased state). In this case, each adjusting cam 51 of the guide adjusting part 36 may have two or more cam faces in order to correspond to the two or more changes in shape of the fixing nip N and to turn the approach guide 35 to two or more positions appropriately.

According to the fixing device 16 of the second embodiment as described above, the pressing adjusting part 73 adjusts (increases or decreases) the pressing force applied on the inner circumferential face 30*a* of the fixing belt 30 by a part (each pressure changing face 78) of the pressure contact face 77 in the left and right direction. Increasing and decreasing of the pressing force changes (increases or decreases) the nip width of the fixing nip N. Accordingly, it becomes possible to form the fixing nip N where the sheet S can be conveyed appropriately, the toner image can be fixed on the sheet S appropriately and the sheet S is hard to be crinkled. In addition, the center pressure decreased nip N20 has the nip width which is wider at the both end portions than at the center portion in the left and right direction. Thus, the force for conveying the sheet S (the conveying force) is larger at the both end portions than at the center portion in the left and right direction. Thereby, the sheet S is conveyed while extending in the left and right direction and, therefore, can be prevented from being crinkled.

The guide adjusting part 36 transmits the rotation force from the pressing adjusting part 73 to the approach guide 35 and turns the approach guide 35 by linking with the deformation of the fixing nip N. The force for rotating each eccentric cam 81 (the rotation force) is transmitted to the approach guide 35 via the guide adjusting part 36 and turns the approach guide 35. That is, the pressing adjusting part 73 is used in common as a drive source which rotates each eccentric cam 81 and turns the approach guide 35. Thereby, the deformation of the fixing nip N and the turning of the approach guide 35 can be linked by a simple configuration.

The fixing device 16 of the second embodiment is provided with the three eccentric cams 81. However, the present disclosure is not limited to the number of the eccentric cam 81. One or more eccentric cams 81 may be provided. For instance, a single eccentric cam 81 may come into contact with the center portion of the pressing member 72 in the left and right direction. Alternatively, four or more eccentric cams 81 may come into contact with the pressing member 72. In addition, the three eccentric cams 81 each has the same shape in the embodiment. However, the present disclosure is not limited to the embodiment. For instance, each end cam 81*a* may be formed such that the pressing force applied on the pressure changing face 78 is larger.

Next, the fixing devices 12 and 16 of modified examples of the first and second embodiments will be described. In the flowing description, the same configuration as the fixing devices 12 and 16 of the first and second embodiments is shown with the same reference number as the first and second embodiments, and its description is omitted.

Under a high temperature and high humidity environment, because of increase in a moisture content of the sheet S, sheet conveying failure may easily occur or the sheet S may be easy to be crinkled. Thus, the fixing devices 12 and 16 of the modified examples are configured to change the fixing nip N depending on the environment condition.

The control device 14 controls the switching adjusting part 41 (or the pressing adjusting part 73) on the basis of a detection result of the temperature/humidity sensor 61 (refer to FIG. 8). In detail, when a humidity detected by the temperature/humidity sensor 61 is higher than a predetermined humidity, the control device 14 switches and controls the switching adjusting part 41 (or the pressing adjusting part 73) to form the first fixing nip N1 (or the center pressure decreased nip N20). Thereby, even in a case of the sheet S which has a large moisture content and is easy to be crinkled, the sheet S can be subjected to the fixing processing without being crinkled. The predetermined humidity to be a reference for performing the above switching control is previously stored (set) in the storage part of the control device 14.

The control device 14 may perform the switching control on the basis of a temperature detected by the temperature/humidity sensor 61, instead of the humidity detected by the temperature/humidity sensor 61. That is, the control device 14 is set to control the switching adjusting part 41 (or the pressing adjusting part 73) on the basis of at least one of the environment temperature and the environment humidity.

In the fixing device 12 of the first embodiment, the switching gear train 48 and the guide gear train 50 are rotated by the switching motor 47. As with this, in the fixing device 16 of the second embodiment, the adjusting gear train 85 and the guide gear train 50 are rotated by the adjusting motor 84. Instead of these configurations, for instance, a dedicated drive motor which rotates each adjusting cam 51 via the guide gear train 50 may be provided separately. In this case, the control device 14 may drive the switching motor 47 (or the adjusting motor 84) synchronously with the drive motor.

In the first and second embodiments, the control device 14 controls the printer 1 totally. However, the present disclosure is not limited to the control device 14. For instance, a dedicated control part which controls the fixing devices 12 and 16 may be separately provided. In addition, in the first and second embodiments, the IH heater 33 is used as the heat source. However, the present disclosure is not limited to the embodiments. For instance, a heat source such as a halogen heater may be disposed in the inner space of the fixing belt 30.

The first and second embodiments were described in a case where configurations of the disclosure are applied to the monochromatic printer 1 as an example. However, the configurations of the disclosure may be applied to a color printer, a copying machine, a facsimile, a multifunctional peripheral or the like, other than the monochromatic printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing member which is rotatable and heated by a heat source;

a pressuring member which is rotatable and forms a fixing nip between the fixing member and the pressuring member;

a deforming part which deforms the fixing nip;

an approach guide which guides a sheet to the fixing nip; and a guide adjusting part which moves the approach guide to a position corresponding to the fixing nip after deformation, as the deforming part deforms the fixing nip.

2. The fixing device according to claim 1, wherein the deforming part includes:

a plurality of pressing members having pressure contact faces which come into pressure contact with an inner circumferential face of the fixing member; and a nip adjusting part which rotates the plurality of pressing members around a rotation shaft so as to switch the pressing member which comes into pressure contact with the inner circumferential face of the fixing member and to deform the fixing nip, the guide adjusting part transmits rotation force from the nip adjusting part to the approach guide and moves the approach guide as the fixing nip is deformed.

3. The fixing device according to claim 2, wherein the nip adjusting part includes:

the rotation shaft disposed in an inner space of the fixing member; and a motor which rotates the rotation shaft, the plurality of pressing members are fixed to the rotation shaft.

4. The fixing device according to claim 3, wherein the deforming part further includes:

a supporting member disposed in the inner space of the fixing member; and a guide member fixed to the supporting member and coming into contact with the inner circumferential face of the fixing member, the rotation shaft is rotatably supported by the supporting member.

5. The fixing device according to claim 1, wherein the deforming part includes:

a pressing member which extends in a direction of a rotation axis of the fixing member and has a pressure contact face coming into pressure contact with an inner circumferential face of the fixing member; and a nip adjusting part which rotates at least one eccentric cam in pressure contact with the pressing member around a rotation axis to change pressing force applied on a part of the pressure contact face in the direction of the rotation axis of the fixing member and to deform the fixing nip, the guide adjusting part transmits rotation force from the nip adjusting part to the approach guide to move the approach guide as the fixing nip is deformed.

6. The fixing device according to claim 5, wherein the at least one eccentric cam includes a plurality of eccentric cams, the plurality of eccentric cams includes;

a center cam disposed on a center portion in the direction of the rotation axis of the fixing member;

end cams disposed on both end portions in the direction of the rotation axis of the fixing member, the center cam has the same shape as the end cams, and a phase of the center cam is shifted from a phase of the end cams.

7. The fixing device according to claim 2, wherein the guide adjusting part includes:

an adjusting cam which is provided in pressure contact with the approach guide and moves the approach guide as the fixing nip is deformed; and a drive transmitting part which transmits rotation force of the nip adjusting part to the adjusting cam.

8. An image forming apparatus comprising:

an image forming part which transfers a toner image on a sheet; and the fixing device according to claim 1, which fixes the toner image on the sheet.

* * * * *